US009520663B1

(12) United States Patent
Chen

(10) Patent No.: US 9,520,663 B1
(45) Date of Patent: Dec. 13, 2016

(54) CONNECTOR

(71) Applicant: WISTRON CORP., New Taipei (TW)

(72) Inventor: Hung-Sheng Chen, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 14/968,727

(22) Filed: Dec. 14, 2015

(30) Foreign Application Priority Data

Sep. 8, 2015 (TW) ..... 104129589 A

(51) Int. Cl.
*H01R 3/00* (2006.01)
*H01R 12/77* (2011.01)

(52) U.S. Cl.
CPC ..... *H01R 12/771* (2013.01)

(58) Field of Classification Search
CPC ..... H01R 13/641
USPC ..... 439/489, 910
See application file for complete search history.

(56) References Cited

U.S. PATENT DOCUMENTS 8,508,946 B2 * 8/2013 Ching ..... H01R 12/79 361/737
8,651,892 B2 * 2/2014 Arant ..... H01R 13/641 439/489
9,093,774 B2 * 7/2015 Chang ..... H01R 13/465
2001/0034156 A1 * 10/2001 Yamane ..... H01R 13/641 439/492

FOREIGN PATENT DOCUMENTS

TW 551638 U 9/2003
TW 201023443 A 6/2010

OTHER PUBLICATIONS

Taiwan Office Action dated Aug. 9, 2016 in application No. 104129589.

* cited by examiner

*Primary Examiner* — Phuong Dinh
(74) *Attorney, Agent, or Firm* — Maschoff Brennan

(57) ABSTRACT

A connector for fixing and electrically connecting a flat cable includes a base body and a first inspection window. The base body includes a bottom part and a top part which are opposite to each other. The bottom part and the top part together form a flat-cable slot and an inserting opening. The flat-cable slot and the inserting opening are communicated with each other. The first inspection window extends through two surfaces of the top part which are opposite to each other. The first inspection window communicated with the flat-cable slot. A portion of the flat-cable slot away from the inserting opening is exposed in the first inspection window, and a position of the flat cable in the flat-cable slot is inspectable through the first inspection window.

15 Claims, 21 Drawing Sheets

CONNECTOR

CROSS-REFERENCE TO RELATED APPLICATIONS

This non-provisional application claims priority under 35 U.S.C. §119(a) on Patent Application No(s). 104129589 filed in Taiwan, R.O.C. on Sep. 8, 2015, the entire contents of which are hereby incorporated by reference.

TECHNICAL FIELD

The disclosure relates to a connector, more particularly to a connector with an inspection window.

BACKGROUND

Generally, the electronic equipment includes electronic components with different functions. These electronic components are electrically connected to each other for transmitting signals. The electronic components in the conventional electronic equipment transmit signals through the flat cables. Each electronic component has at least one connector with multiple pins inside. When the electronic components are assembled into the electronic equipment, the flat cable is inserted and fixed in the connector, and the pins are electrically connected to the conductive lines encapsulated in the plastic skins, respectively, so that electrical connection relationship between the electronic components is built quickly.

SUMMARY

According to one embodiment of the disclosure, a connector for fixing and electrically connecting a flat cable includes a base body and a first inspection window. The base body includes a bottom part and a top part which are opposite to each other. The bottom part and the top part together form a flat-cable slot and an inserting opening. The flat-cable slot and the inserting opening are communicated with each other. The first inspection window extends through two surfaces of the top part which are opposite to each other. The first inspection window communicated with the flat-cable slot. A portion of the flat-cable slot away from the inserting opening is exposed in the first inspection window, and a position of the flat cable in the flat-cable slot is inspectable through the first inspection window

BRIEF DESCRIPTION OF THE DRAWINGS

The disclosure will become better understood from the detailed description given hereinbelow and the accompanying drawings which are given by way of illustration only and thus are not limitative of the disclosure and wherein.

DETAILED DESCRIPTION

Figure 1:
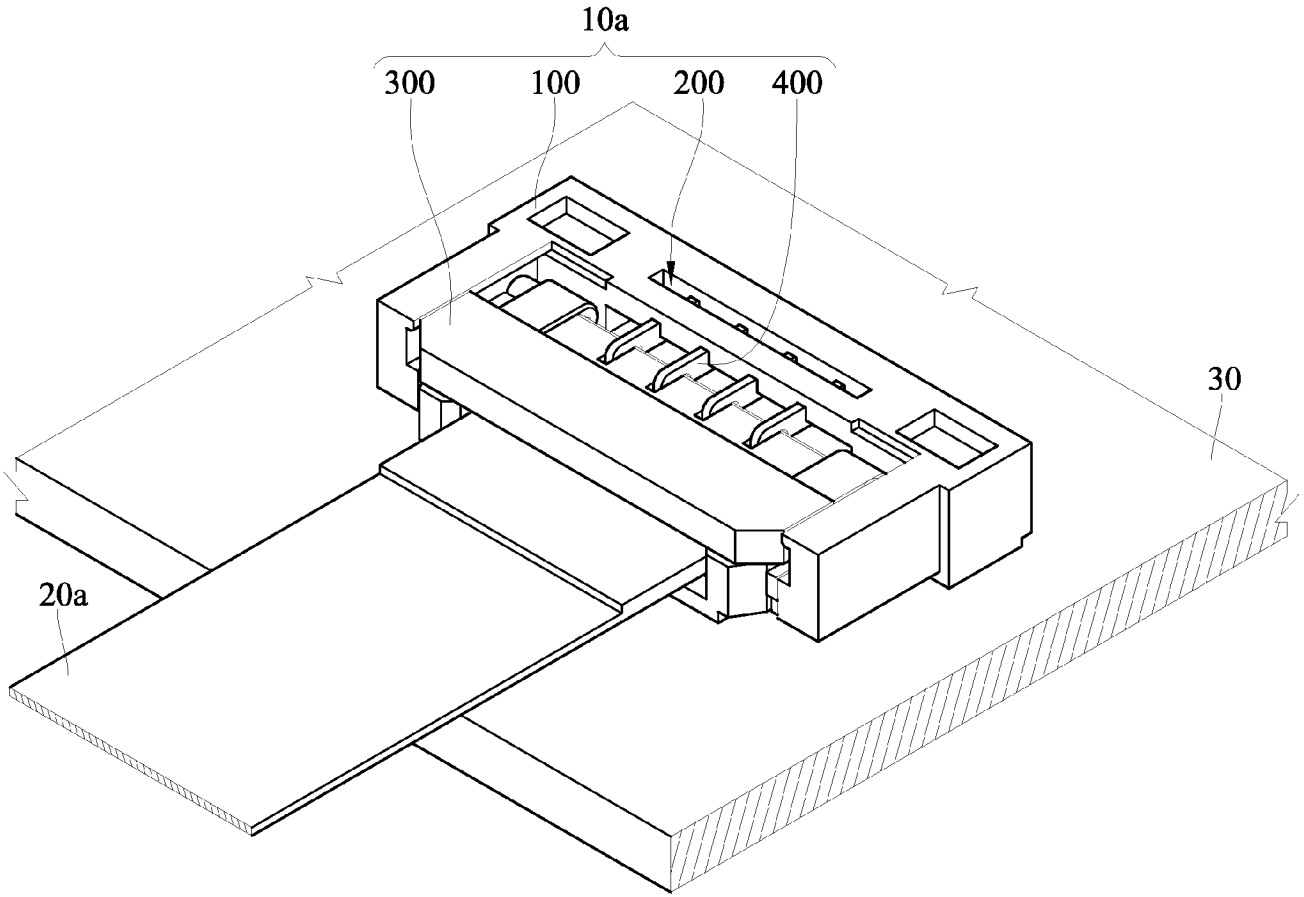
FIG. 1 is a schematic view of a connector, a flat cable and a circuit board according to a first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
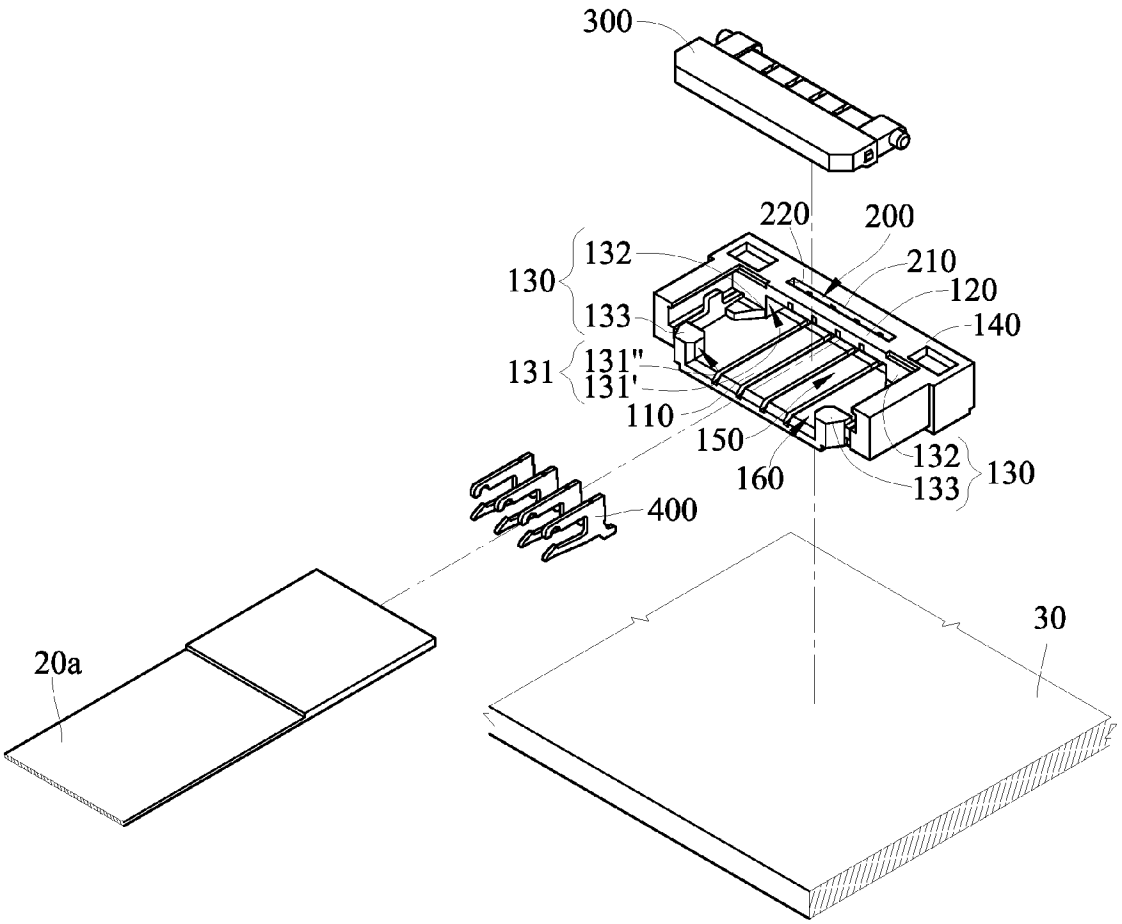
FIG. 2 is an exploded view of the connector, the flat cable and the circuit board illustrated in FIG. 1.
Figure 3A:
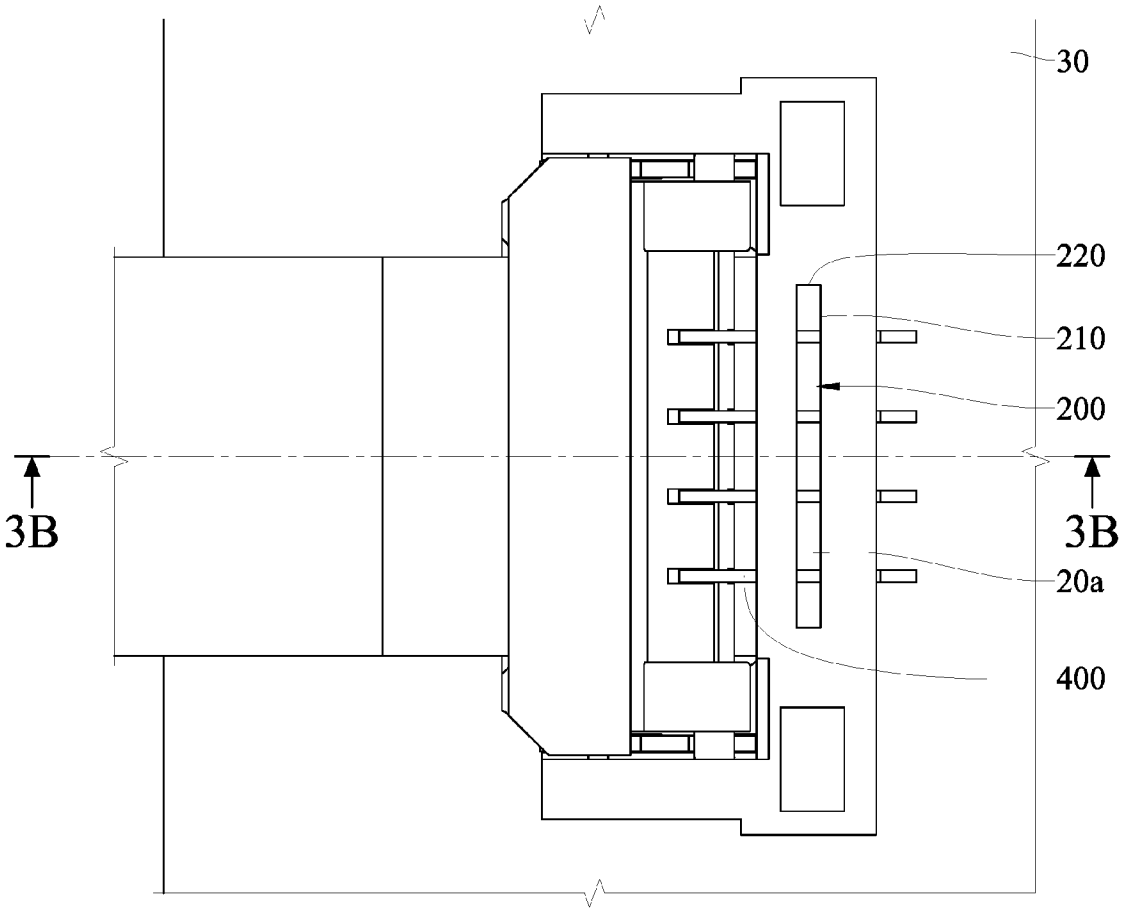
FIG. 3A is a top view of the connector with the flat cable correctly inserted into the connector according to the first embodiment of the disclosure.
Figure 3B:
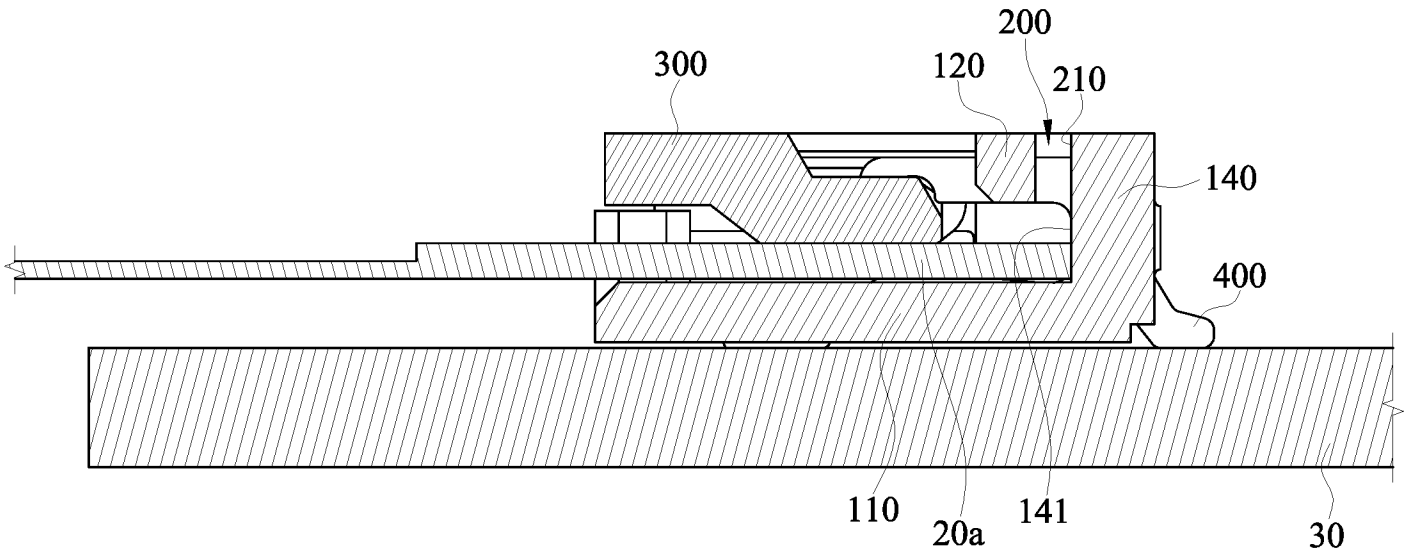
FIG. 3B is a cross-sectional view of the connector and the flat cable along a line 3B-3B in FIG. 3A.
Figure 4A:
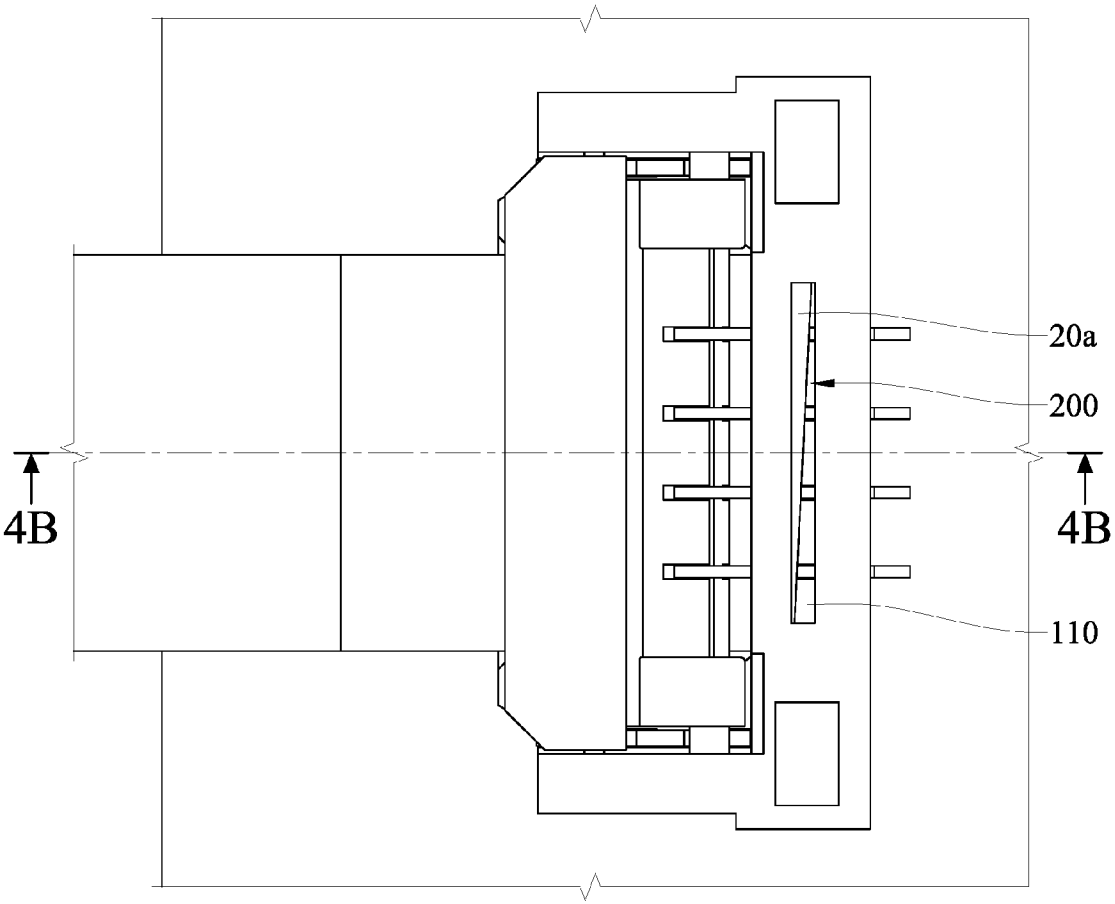
FIG. 4A is a top view of the connector with the flat cable incorrectly inserted into the connector according to the first embodiment of the disclosure.
Figure 4B:
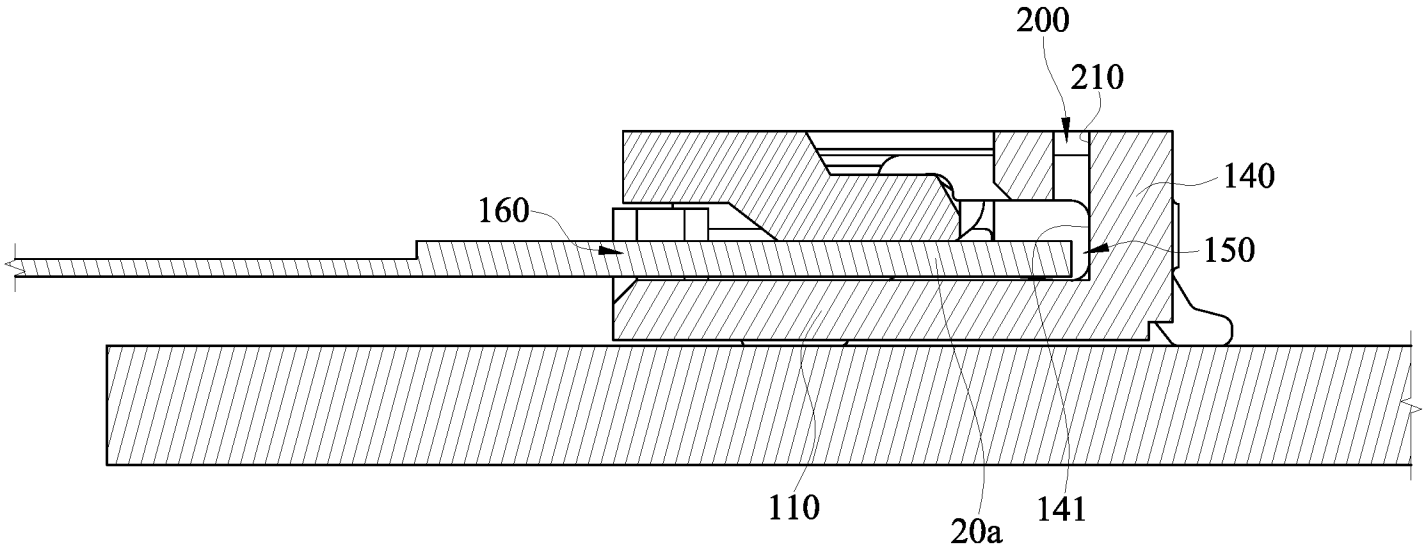
FIG. 4B is a cross-sectional view of the connector and the flat cable along a line 4B-4B in FIG. 4A.

Please refer to FIG. 1 to FIG. 4B. FIG. 1 is a schematic view of a connector, a flat cable and a circuit board according to a first embodiment of the disclosure. FIG. 2 is an exploded view of the connector, the flat cable and the circuit board illustrated in FIG. 1. FIG. 3A is a top view of the connector with the flat cable correctly inserted into the connector according to the first embodiment of the disclosure. FIG. 3B is a cross-sectional view of the connector and the flat cable along a line 3B-3B in FIG. 3A. FIG. 4A is a top view of the connector with the flat cable incorrectly inserted into the connector according to the first embodiment of the disclosure. FIG. 4B is a cross-sectional view of the connector and the flat cable along a line 4B-4B in FIG. 4A. In the first embodiment of the disclosure, the connector 10*a* is suitable for fixing and electrically connecting a flat cable 20*a* on a circuit board 30. However, the disclosure is not limited to the electrical component with the connector which the flat cable is electrically connected and fixed to. In other embodiments of the disclosure, the connector can be used for fixing and electrically connecting the flat cable or an electric wire to a connection hole of an electronic device or the circuit board.

The connector 10*a* includes a base body 100, a first inspection window 200, a cover 300 and four pins 400. The base body 100 includes a bottom part 110, a top part 120, two side parts 130 and a stopper 140. The bottom part 110 is located on a surface of a circuit board 30. The top part 120 and the bottom part 110 are spaced apart by a distance and face each other. The two side parts 130 stand on a surface of the bottom part 110. The stopper 140 is connected to the bottom part 110, the top part 120 and two side parts 130 to form a flat-cable slot 150 and an inserting opening 160, which are communicated with each other, together. The stopper 140 and the inserting opening 160 are located at two opposite sides of the flat-cable slot 150. Specifically, each of the two side parts 130 has a side surface 131. The two side surfaces 131 face each other and are spaced apart by a distance. The stopper 140 has a stop surface 141. The two side surfaces 131 and the stop surface 141 surround and form the flat-cable slot 150 together, and the stop surface 141 faces the inserting opening 160.

The flat cable 20*a* can be inserted into the flat-cable slot 150 from the inserting opening 160 along an inserting direction, and the end of the flat cable 20*a* is abutted against the stop surface 141 of the stopper 140 when the flat cable 20*a* is correctly inserted in the flat-cable slot 150. In the first embodiment of the disclosure, the inserting direction is parallel to a normal line of the stop surface 141. When the flat cable 20*a* is inserted into the flat-cable slot 150 through the inserting opening 160, the two side surfaces 131 respectively contact two opposite sides of the flat cable 20*a* so as to guide the flat cable 20*a* to move toward the stop surface 141.

In the first embodiment of the disclosure, each of the two side parts 130 includes a first block 132 and a second block 133 which are spaced apart. Each of the two side surfaces 131 is formed by a side surface 131' of the first block 132 and a side surface 131" of the second block 133. The two first blocks 132 are located at one end of the surface of the bottom part 110 and connected to the stopper 140, the bottom part 110 and the top part 120. The two second blocks 133 are located at another end of the surface of the bottom part 110 and connected to the bottom part 110 and the top part 120. The two first blocks 132, the two second blocks 133, the bottom part 110, the top part 120 and the stopper 140 form the flat-cable slot 150 together. Moreover, the two second blocks 133 and the bottom part 110 form the inserting opening 160 together. In the first embodiment of the disclosure, the side part 130 is consisted of two separated blocks, and the stopper 140 is a single plate. However, the disclosure is not limited to the configuration of the side part and the stopper. In other embodiments of the disclosure, the side part 130 can be a single plate, and the stopper can be consisted by multiple separated blocks. In the first embodiment of the disclosure, the stopper 140 is connected to the bottom part 110, the top part 120 and the two side parts 130, but the disclosure is not limited thereto. In other embodiments of the disclosure, the stopper can be connected to the two side parts and separated from the bottom part and the top part.

The first inspection window 200 extends through two surfaces of the top part 120, which are opposite to each other, and is communicated with the flat-cable slot 150. The first inspection window 200 has a long side 210 and a short side 220. The long side 210 is longer than the short side 220. An extending direction of the long side 210 is perpendicular to the insertion direction which the flat cable 20*a* is inserted into the flat-cable slot 150 from the inserting opening 160 along. A section of the flat-cable slot 150 away from the inserting opening 160 is inspectable through the first inspection window 200. In other words, a section of the flat-cable slot 150 close to the stop surface 141 of the stopper 140 is exposed in the first inspection window 200. When the flat cable 20*a* is inserted into the flat-cable slot 150, quality control stuffs can inspect an alignment of the stop surface 141 and an end section of the flat cable 20*a* through the first inspection window 200.

In the first embodiment of the disclosure, the long side 210 of the first inspection window 200 is connected to the stop surface 141 of the stopper 140, and the first inspection window 200 extends from the stop surface 141 toward the inserting opening 160, but the disclosure is not limited thereto. In other embodiments of the disclosure, the long side of the first inspection window is spaced apart from the stop surface, and the quality control stuffs can still inspect the alignment of the stop surface and the end of the flat cable through the first inspection window.

The cover 300 is pivoted on the top part 120, and the cover 300 can rotate relative to the base body 100 and have an open position and a fixing position. When the cover 300 is at the fixing position, the cover 300 covers the flat-cable slot 150 and fixes the flat cable 20*a* in the flat-cable slot 150 with the bottom part 110. When the cover 300 is located at the open position, the flat-cable slot 150 is exposed and the flat cable 20*a* is released.

The four pins 400 are embedded in the base body 100, and the four pins are spaced apart from each others. Each of the four pins 400 has a part protruded into the flat-cable slot 150 from the bottom part 110. When the flat cable 20*a* is fixed in the flat-cable slot 150 by the cover 300, the parts of the four pins 400 protruded into the flat-cable slot 150 are electrically connected to metal conductive lines (not shown in the drawings) in the flat cable 20*a*, respectively. Each of the four pins 400 also has another part protruded from the stopper 140 and electrically connected to the circuit board 30. As a result, current can pass the flat cable 20*a* and the pin 400 to the circuit board 30. In the first embodiment of the disclosure, the number of the pin is four. However, the disclosure is not limited to the number of the pin. In other embodiments of the disclosure, the number of the pin can be one, two, three or more than four.

The following is about inspecting the position of the flat cable 20*a* in the flat-cable slot 150. Please refer to FIG. 3A to FIG. 4B.

As shown in FIG. 3, when the end section of the flat cable 20*a* is correctly inserted into the flat-cable slot 150, the end section of the flat cable 20*a* is abutted against the stop surface 141 of the stopper 140. Therefore, the end of the flat-cable slot 150 exposed in the first inspection window 200 is totally covered by the flat cable 20*a*. As a result, whether the end of the flat-cable slot 150 is totally covered by the flat cable 20*a* can be used for determining the end section of the flat cable 20*a* is correctly inserted into the flat-cable slot 150 or not by the quality control stuffs. Moreover, whether a space existed between the end section of the flat cable 20*a* and the stop surface 141 can be used for determining whether a moving direction of the flat cable 20*a* is deviated from the inserting direction of the flat-cable slot 150 or not.

As shown in FIG. 4A and FIG. 4B, when the end section of the flat cable 20*a* is incorrectly inserted into the flat-cable slot 150, the end section of the flat cable 20*a* is spaced apart from the stop surface 141 of the stopper 140, and, for example, a rectangle shaped gap or a trapezoid shaped gap is formed between the end section of the flat cable 20*a* and the stop surface 141. Therefore, a part of the end of the flat-cable slot 150 is not covered by the flat cable 20*a* and exposed in the first inspection window 200. When the moving direction of the flat cable 20*a* is deviated from the inserting direction which the flat cable 20*a* can be correctly inserted into the flat-cable slot 150 along, a part of the end section of the flat cable 20*a* is in contact with the stop surface 141, but a part of the end section of the flat cable 20*a* is spaced apart from the stop surface 141. Therefore, a gap, which usually shows a triangle shape, is formed between the end section of the flat cable 20*a* and the stop surface 141.

As a result, the quality control stuffs can inspect whether the flat cable 20*a* is correctly inserted into the flat-cable slot 150 and whether the moving direction of the flat cable 20*a* is deviated from the inserting direction of the flat-cable slot 150 through the first inspection window 200. Therefore, a situation that the connector 10*a* with a misaligned flat cable 20*a* in the flat-cable slot 150, which causes poor contact between the pins 400 and the metal conductive line, is prevented.

Figure 5:
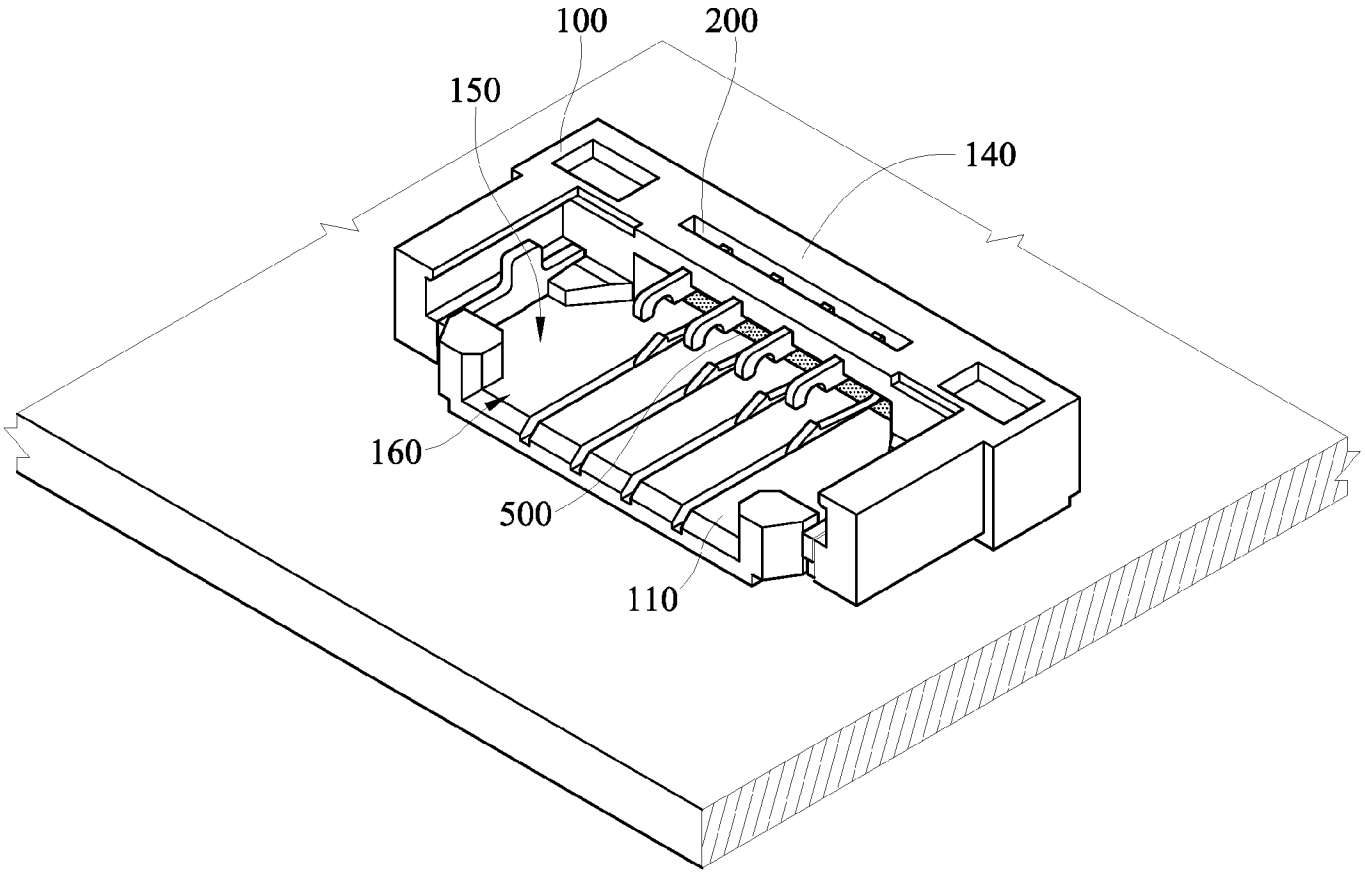
FIG. 5 is a schematic view of a connector and a circuit board according to a second embodiment of the disclosure.
Figure 6A:
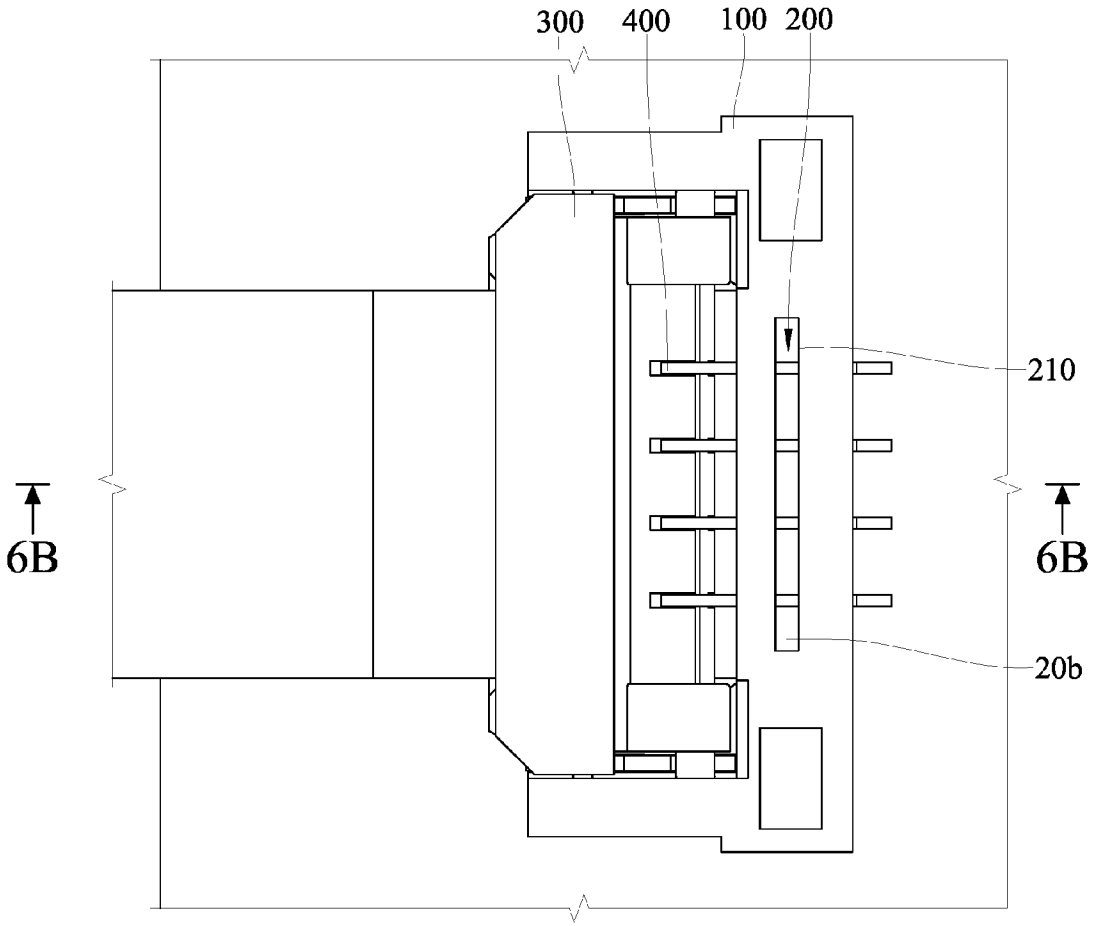
FIG. 6A is a top views of the connector with the flat cable correctly inserted into the connector according to the second embodiment of the disclosure.
Figure 6B:
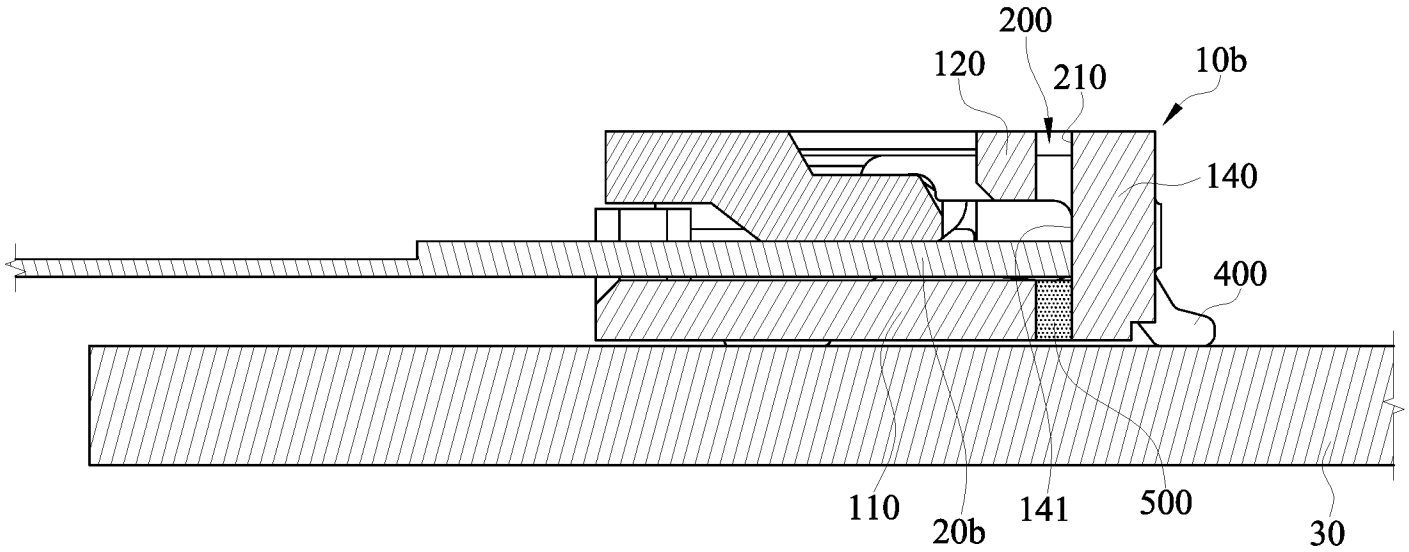
FIG. 6B is a cross-sectional view of the connector and the flat cable along a line 6B-6B in FIG. 6A.
Figure 7A:
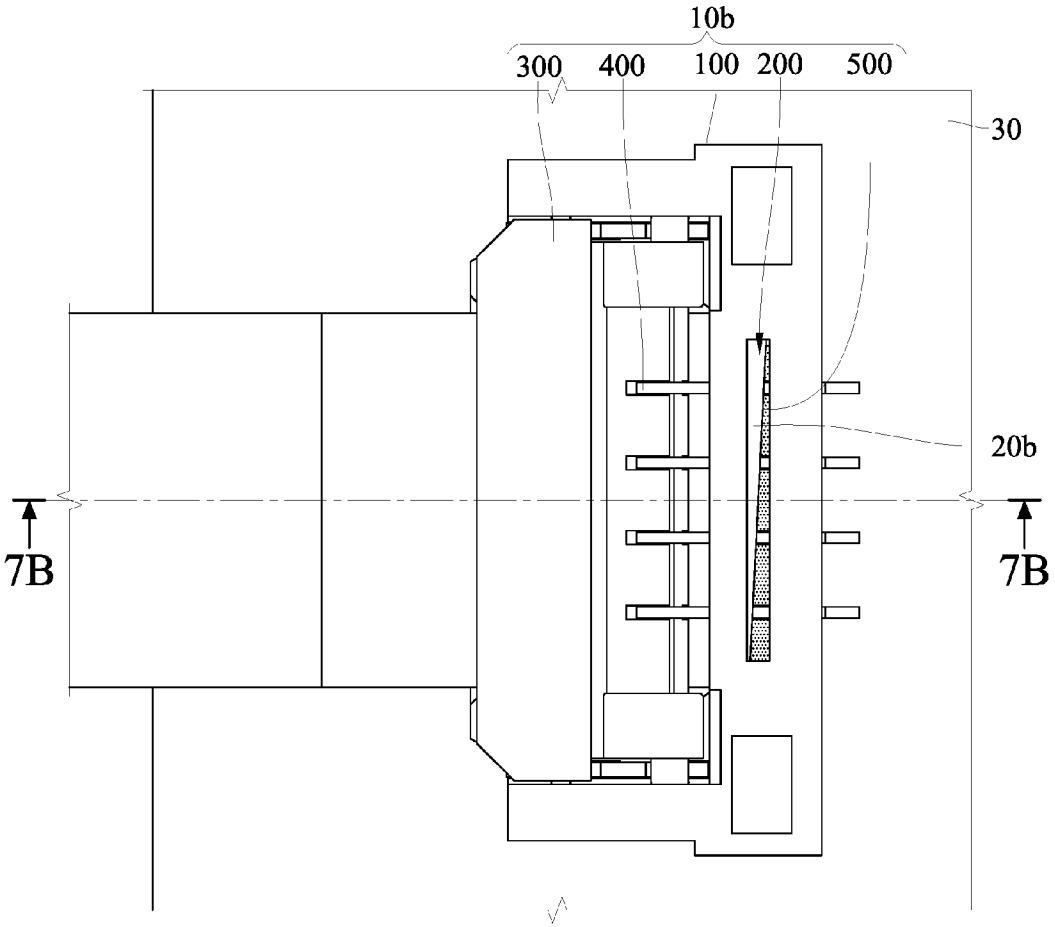
FIG. 7A is a top view of the connector with the flat cable incorrectly inserted into the connector according to the second embodiment of the disclosure.
Figure 7B:
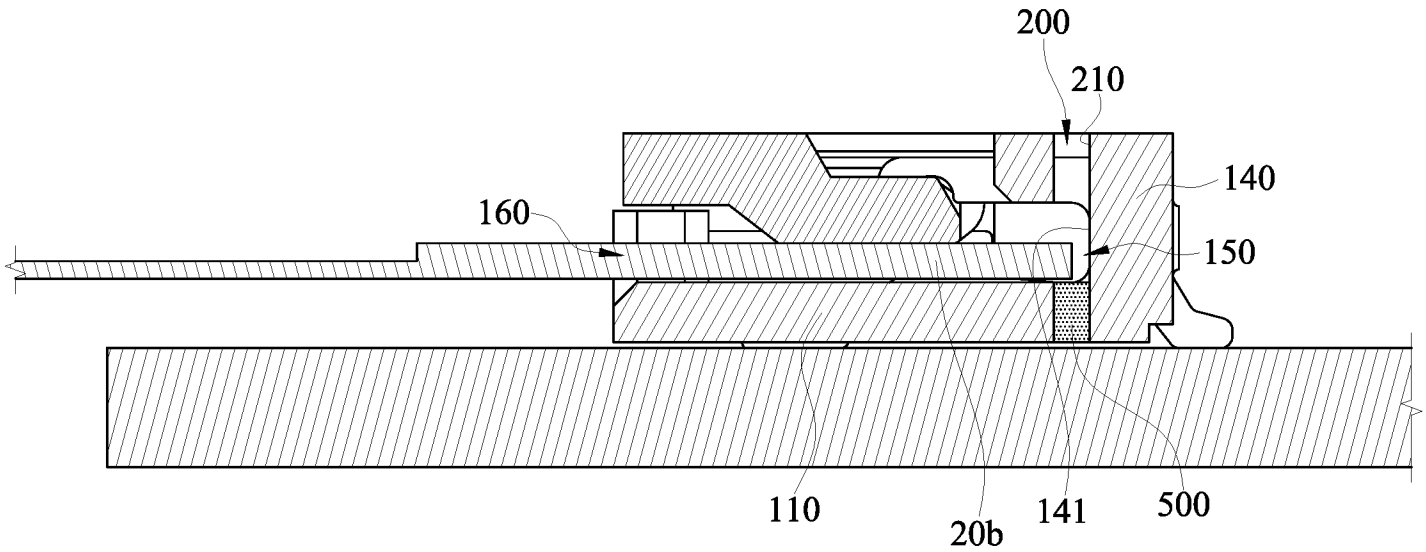
FIG. 7B is a cross-sectional view of the connector and the flat cable along a line 7B-7B in FIG. 7A.

Next, a connector 10*b* according to a second embodiment of the disclosure is shown in FIG. 5 to FIG. 7B. FIG. 5 is a schematic view of a connector and a circuit board according to a second embodiment of the disclosure. FIG. 6A is a top views of the connector with the flat cable correctly inserted into the connector according to the second embodiment of the disclosure. FIG. 6B is a cross-sectional view of the connector and the flat cable along a line 6B-6B in FIG. 6A. FIG. 7A is a top view of the connector with the flat cable incorrectly inserted into the connector according to the second embodiment of the disclosure. FIG. 7B is a cross-sectional view of the connector and the flat cable along a line 7B-7B in FIG. 7A. In the second embodiment of the disclosure, the connector 10*b* is similar to the connector 10*a* in the first embodiment, and each of the similar components is given the same sign, respectively. The followings are about the differences between the connector 10*b* and the connector 10*a*, and the descriptions of the similar components are not repeated hereafter.

In the second embodiment of the disclosure, the connector 10*b* further includes a first mark 500. The first mark 500 is located at an end of the bottom part 110 away from the inserting opening 160. Specifically, an edge of the first mark 500 is connected to the stop surface 141 of the stopper 140 so that the first mark 500 is exposed in the flat-cable slot 150 and the first inspection window 200 as a basis for checking an alignment of the flat cable 20*b*.

In the second embodiment of the disclosure, the first mark 500 is a through hole or a color sign, but the disclosure is not limited thereto. In other embodiments of the disclosure, the first mark can be a groove. When the first mark 500 is the through hole, the through hole extends two opposite sides of the bottom part 110 so as to expose the circuit board 30 under the bottom part 110. When the first mark 500 is the color sign, a color of the color sign is colorful and distinctive, such as red or yellow.

The following is about inspecting the position of the flat cable 20*b* in the flat-cable slot 150. Please refer to FIG. 6A to FIG. 7B.

When the end section of the flat cable 20*b* is correctly inserted into the flat-cable slot 150, the end section of the flat cable 20*b* is abutted against the stop surface 141 of the stopper 140. Therefore, the first mark 500 exposed in the first inspection window 200 is totally covered by the flat cable 20*b*. As a result, whether the first mark 500 is totally covered by the flat cable 20*b* can be used for determining the end section of the flat cable 20*b* is correctly inserted into the flat-cable slot 150 or not by the quality control stuffs. Moreover, whether a distance between the end section of the flat cable 20*b* and the stop surface 141 is uniform can be used for determining whether a moving direction of the flat cable 20*b* is deviated from the inserting direction of the flat-cable slot 150.

When the end section of the flat cable 20*b* is not correctly inserted into the flat-cable slot 150, the end section of the flat cable 20*b* is spaced apart from the stop surface 141 of the stopper 140, and, for example, a rectangle shaped gap or a trapezoid shaped gap is formed between the end section of the flat cable 20*b* and the stop surface 141. Therefore, a part of the first mark 500 is not covered by the flat cable 20*b* and exposed in the inspection window 200. As shown in FIG. 7A and FIG. 7B, when the moving direction of the flat cable 20*b* is deviated from the inserting direction of the flat-cable slot 15 and the flat cable 20*b* is not correctly inserted into the flat-cable slot 150, a part of the end section of the flat cable 20*b* is in contact with the stop surface 141, but a part of the end section of the flat cable 20*b* is not in contact with the stop surface 141. Therefore, a part of the first mark 500 not covered by the flat cable 20*b*, which usually shows a triangle shape, is exposed in the first inspection window 200.

As a result, the quality control stuffs can inspect whether the flat cable 20*b* is correctly inserted into the flat-cable slot 150 and whether the moving direction of the flat cable 20*b* is deviated from the inserting direction of the flat-cable slot 150 by the first inspection window 200. Therefore, a situation that the connector 10*b* with a misaligned flat cable 20*b* in the flat-cable slot 150, which cause poor contact between the pins 400 and the metal conductive line, is prevented.

Figure 8:
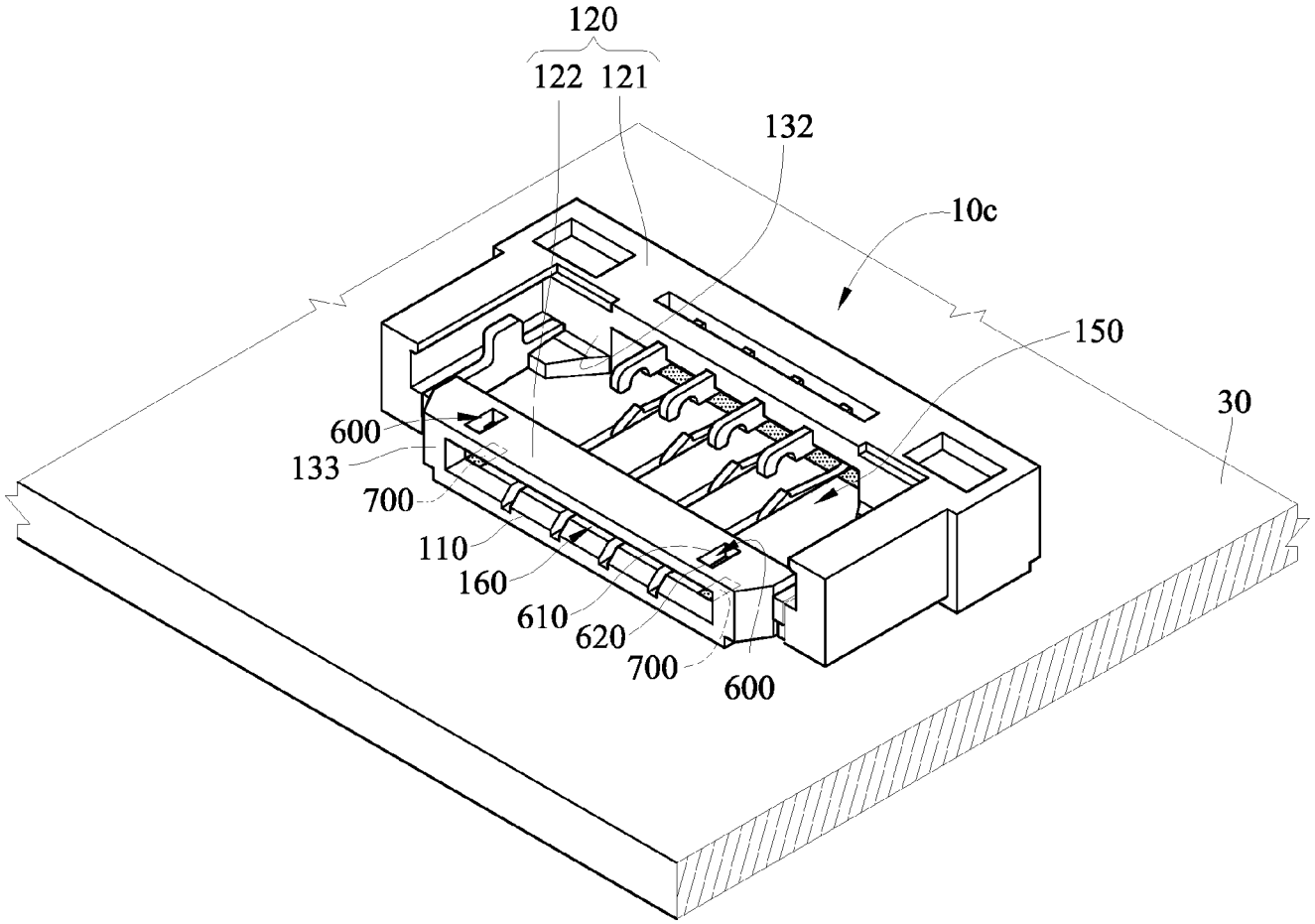
FIG. 8 is a schematic view of a connector and a circuit board according to a third embodiment of the disclosure.
Figure 9A:
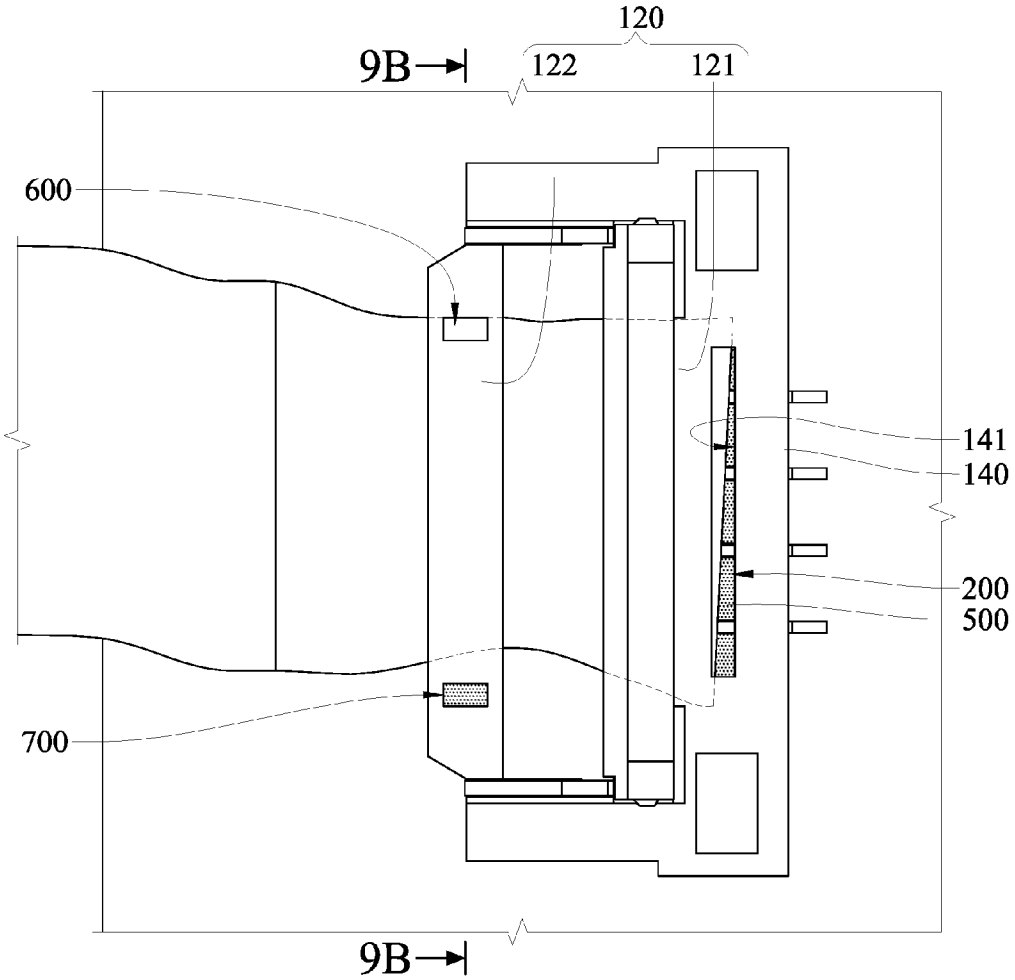
FIG. 9A is a top view of the connector with the flat cable incorrectly inserted into the connector according to the third embodiment of the disclosure.
Figure 9B:
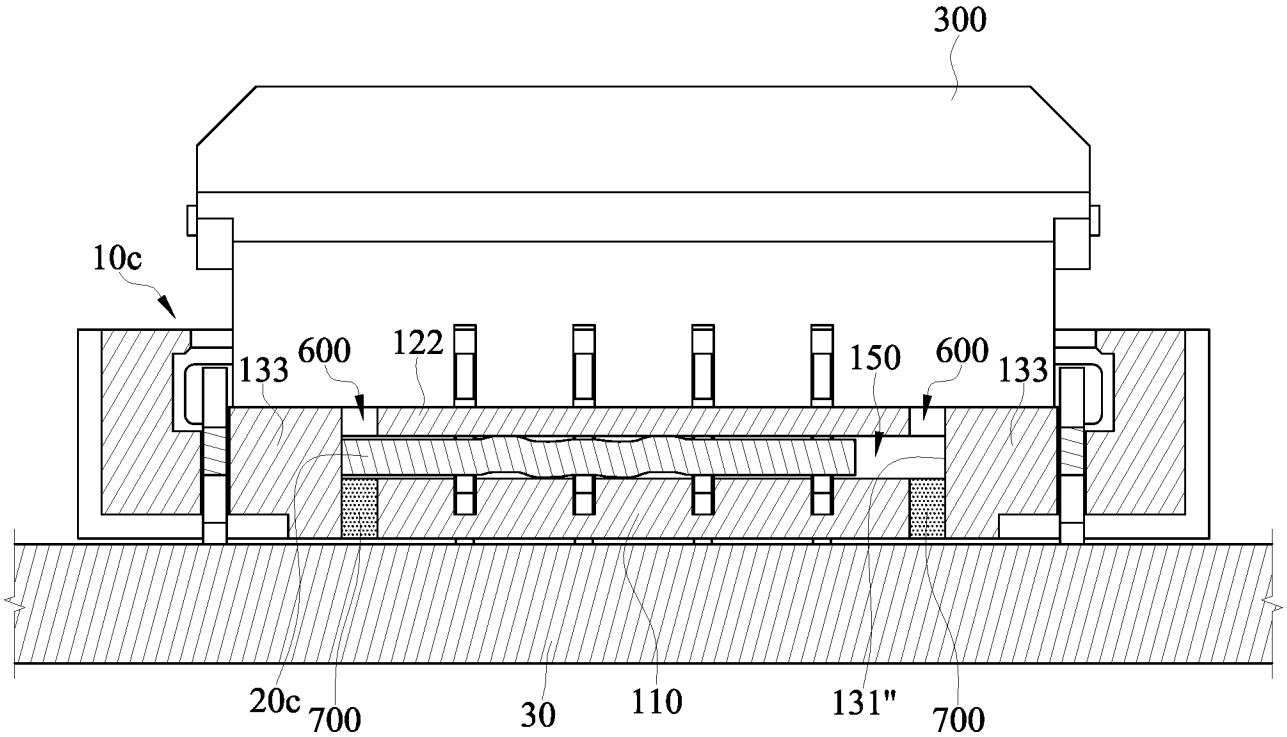
FIG. 9B is a cross-sectional view of the connector and the flat cable along a line 9B-9B in FIG. 9A.

Next, a connector 10*c* according to a third embodiment of the disclosure is shown in FIG. 8 to FIG. 9B. FIG. 8 is a schematic view of a connector and a circuit board according to a third embodiment of the disclosure. FIG. 9A is a top view of the connector with the flat cable incorrectly inserted into the connector according to the third embodiment of the disclosure. FIG. 9B is a cross-sectional view of the connector and the flat cable along a line 9B-9B in FIG. 9A. In the third embodiment of the disclosure, the connector 10*c* is similar to the connector 10*b* in the second embodiment, and each of the similar components is given the same sign, respectively. The followings are about the differences between the connector 10*c* and the connector 10*b*, and the descriptions of the similar components are not repeated hereafter.

In the third embodiment of the disclosure, the connector 10*c* further includes two second inspection windows 600 and two second marks 700. The top part 120 includes a first part 121 and a second part 122. The first part 121 of the top part 120 and the bottom part 110 faces each other and are spaced apart by a distance. The stopper 140 is connected to the bottom part 110 and the first part 121 of the top part 120. The second part 122 of top part 120 is connected to the two second blocks 133 of the two side parts 130. The bottom part 110, the top part 120, the two side parts 130 and the stopper 140 form the flat-cable slot 150 and the inserting opening 160, which are communicated to each other, together. Specifically, the bottom part 110, the first part 121 of the top part 120, the two first blocks 132 of the two side parts 130 and the stopper 140 form the flat-cable slot 150 together, and the bottom part 110, the second part 122 among the top part 120, and two second blocks of the two side parts 130 form the inserting opening 160 together.

Each of the two second inspection windows 600 extends through two opposite surfaces of the second part 122 among the top part 120 and is communicated with the flat-cable slot 150. Each of the two second inspection windows 600 has a long side 610 and a short side 620. The long side 610 is longer than the short side 620. An extending direction of the long side 610 is parallel to the insertion direction which the flat cable 20*c* is inserted into the flat-cable slot 150 from the inserting opening 160 along. Two ends of the flat-cable slot 150 close to two side surfaces 131" of the second block 133, which face each other, are exposed in the two second inspection windows 600, respectively. When the cover 300 is at the fixing position, the two second inspection windows 600 are covered by the cover 300. When the cover 300 is rotated from the fixing position to the open position, the two second inspection windows 600 are uncovered so that the quality control stuffs can inspect the position of the flat cable 20*c* in the flat-cable slot 150 through the two second inspection windows 600.

In the third embodiment of the disclosure, the two sides 610 of the two second inspection windows 600 are connected to the two second blocks 133, respectively, but the disclosure is not limited thereto. In other embodiments of the disclosure, the two sides of the two second inspection windows are spaced apart from the two second block, respectively.

The two second marks 700 are located at two ends of the bottom part 110 close to the two side surfaces 131" of the two side parts 130, respectively. Specifically, two ends of the two second marks 700 are connected to the two side surfaces 131" of the two second blocks 133, respectively, so that the two second marks 700 are exposed in the two second inspection windows 600. In the third embodiment of the disclosure, the second mark 700 is a through hole or a color sign, but the disclosure is not limited thereto. In other embodiments of the disclosure, the second mark can be a groove. When the second mark 700 is the through hole, the through hole extends two opposite sides of the bottom part 110 so as to expose the circuit board 30 under the bottom part 110. When the first mark 500 is the color sign, a color of the color sign is colorful and distinctive, such as red or yellow.

The following is about inspecting the position of the flat cable 20*c* in the flat-cable slot 150 when the cover 300 is at the open position. Please refer to FIG. 9A and FIG. 9B.

When the moving direction of the flat cable 20*c* is deviated from the inserting direction of the flat-cable slot 15 and the flat cable 20*c* is not correctly inserted into the flat-cable slot 150, a part of the end section of the flat cable 20*c* is in contact with the stop surface 141, but a part of the end section of the flat cable 20*c* is spaced apart from the stop surface 141. Therefore, a part of the first mark 500, which is not covered by the flat cable 20*b* and usually shows a triangle shape, is exposed in the first inspection window 200.

Moreover, a part of one of two side ends of the flat cable 20*c* pressed against a side surface of one of the two second blocks 133 shows flexural deformation, and a part of the other one of the two side ends is spaced apart from a side surface of the other one of the two second blocks 133. Therefore, one of the two second marks 700 is not covered by the flat cable 20*c* and exposed in one of the two second inspection windows 600, and the other one of the two second marks 700 is covered by the flat cable 20*c* and not exposed in the other one of the two second inspection windows 600.

As a result, when the cover 300 is at the open position, the quality control stuffs can inspect whether the flat cable 20*c* is correctly inserted into the flat-cable slot 150 and whether the moving direction of the flat cable 20*b* is deviated from the inserting direction of the flat-cable slot 150 by the first inspection window 200 and the second inspection window 600. The inspection through the first inspection window 200 and the second inspection window 600 can improve the precision of the inspection result. Therefore, a situation that the connector 10*c* with a misaligned flat cable 20*c* in the flat-cable slot 150, which cause poor contact between the pins 400 and the metal conductive line, is prevented.

In the third embodiment of the disclosure, the second inspection window 600 and the second mark 700 cooperate with the first inspection window 200 and the first mark 500 so as to improve the precision of the inspection result. However, the disclosure is not limited to the combination of the first inspection window 200, the first mark 500, the second inspection window 600 and the second mark 700. In other embodiments of the disclosure, the second inspection window and the second mark can cooperate with the first inspection window without the first mark to improve the precision of the inspection result, or the second inspection window without the second mark can cooperate with the first inspection window without the first mark to improve the precision of the inspection result.

Figure 10:
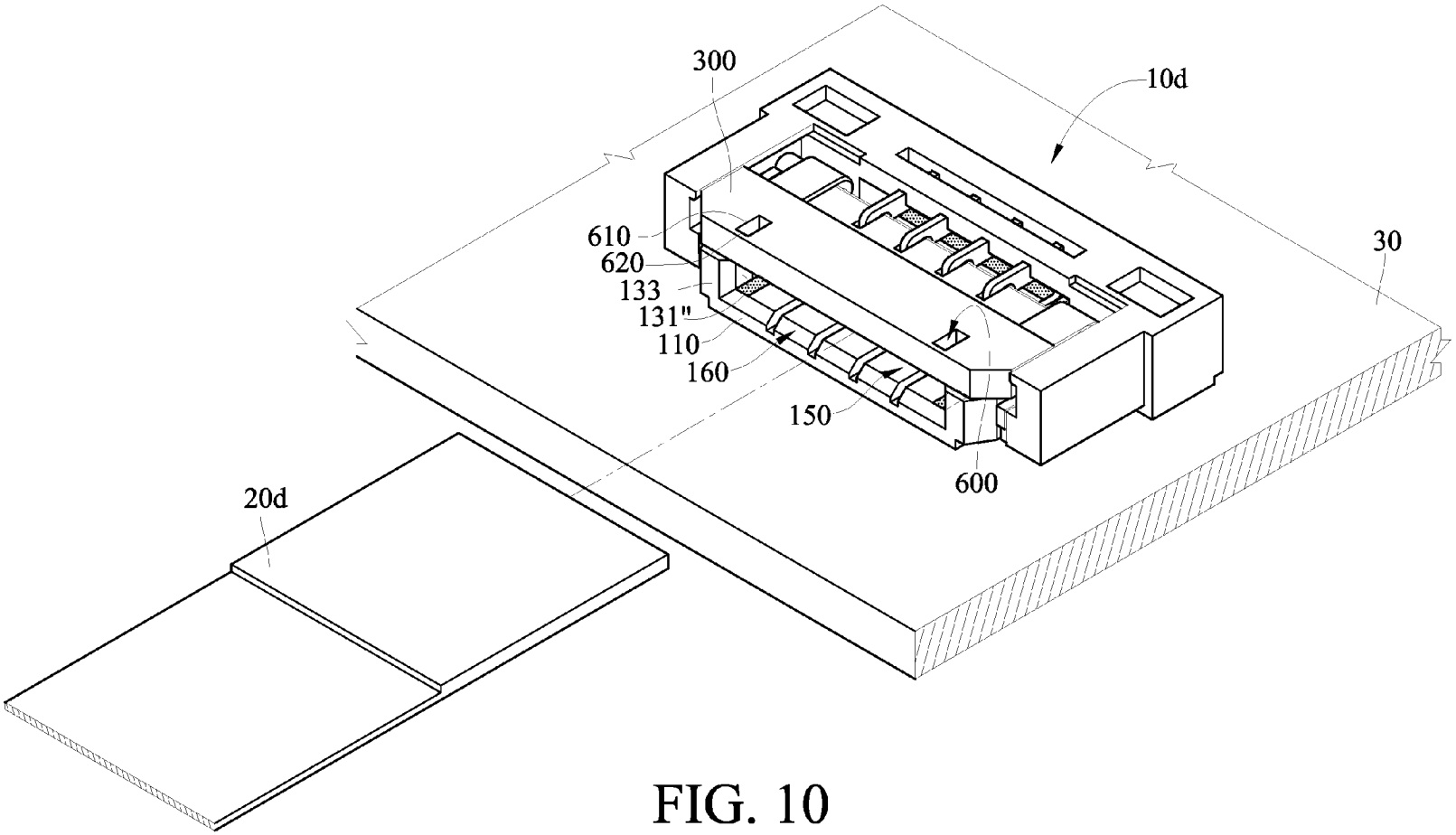
FIG. 10 is a schematic view of a connector and a circuit board according to a fourth embodiment of the disclosure.

Next, a connector 10*d* according to a fourth embodiment of the disclosure is shown in FIG. 10. FIG. 10 is a schematic view of a connector and a circuit board according to a fourth embodiment of the disclosure. In the fourth embodiment of the disclosure, the connector 10*d* is similar to the connector 10*b* in the second embodiment, and each of the similar components is given the same sign, respectively. The followings are about the differences between the connector 10*d* and the connector 10*b*, and the descriptions of the similar components are not repeated hereafter.

In the fourth embodiment of the disclosure, the connector 10*c* further includes two second inspection windows 600 and two second marks 700. Each of the two second inspection windows 600 extends through two opposite surfaces of the cover 300 and is communicated with the flat-cable slot 150. Each of the two second inspection windows 600 has a long side 610 and a short side 620. The long side 610 is longer than the short side 620. An extending direction of the long side 610 is parallel to the insertion direction which the flat cable 20*d* is inserted into the flat-cable slot 150 from the inserting opening 160 along. Two ends of the flat-cable slot 150 close to two side surfaces 131" of the second block 133, which are facing each other, are exposed in the two second inspection windows 600, respectively. When the cover 300 is at the fixing position, the two second inspection windows 600 are covered by the cover 300. When the cover 300 is rotated from the fixing position to the open position, the two second inspection windows 600 are uncovered so as the quality control stuffs can inspect the position of the flat cable 20*d* in the flat-cable slot 150 through the two second inspection windows 600.

In the fourth embodiment of the disclosure, the two long sides 610 of the two second inspection windows 600 are connected to the two second blocks 133, respectively, but the disclosure is not limited thereto. In other embodiments of the disclosure, the two long sides of the two second inspection windows are spaced apart from the two second block, respectively.

The two second marks 700 are located at two ends of the bottom part 110 close to the two side surfaces 131" of the two side parts 130, respectively. Specifically, two ends of the two second marks 700 are connected to the two side surfaces 131" of the two second blocks 133, respectively, so that the two second marks 700 are exposed in the two second inspection windows 600. In the third embodiment of the disclosure, the second mark 700 is a through hole or a color sign, but the disclosure is not limited thereto. In other embodiments of the disclosure, the second mark can be a groove. When the second mark 700 is the through hole, the through hole extends two opposite sides of the bottom part 110 so as to expose the circuit board 30 under the bottom part 110. When the first mark 500 is the color sign, a color of the color sign is colorful and distinctive, such as red or yellow.

In the fourth embodiment of the disclosure, the method for inspecting the position of the flat cable 20*d* in the flat-cable slot 150 when the cover 300 is at the open position is similar to the inspecting method described in the third embodiment of the disclosure. The difference between the inspection method in the fourth embodiment and the inspection method in the third embodiment is that the cover 300 is at the fixing position when inspecting the position of the flat cable 20*d* in the fourth embodiment.

Figure 11:
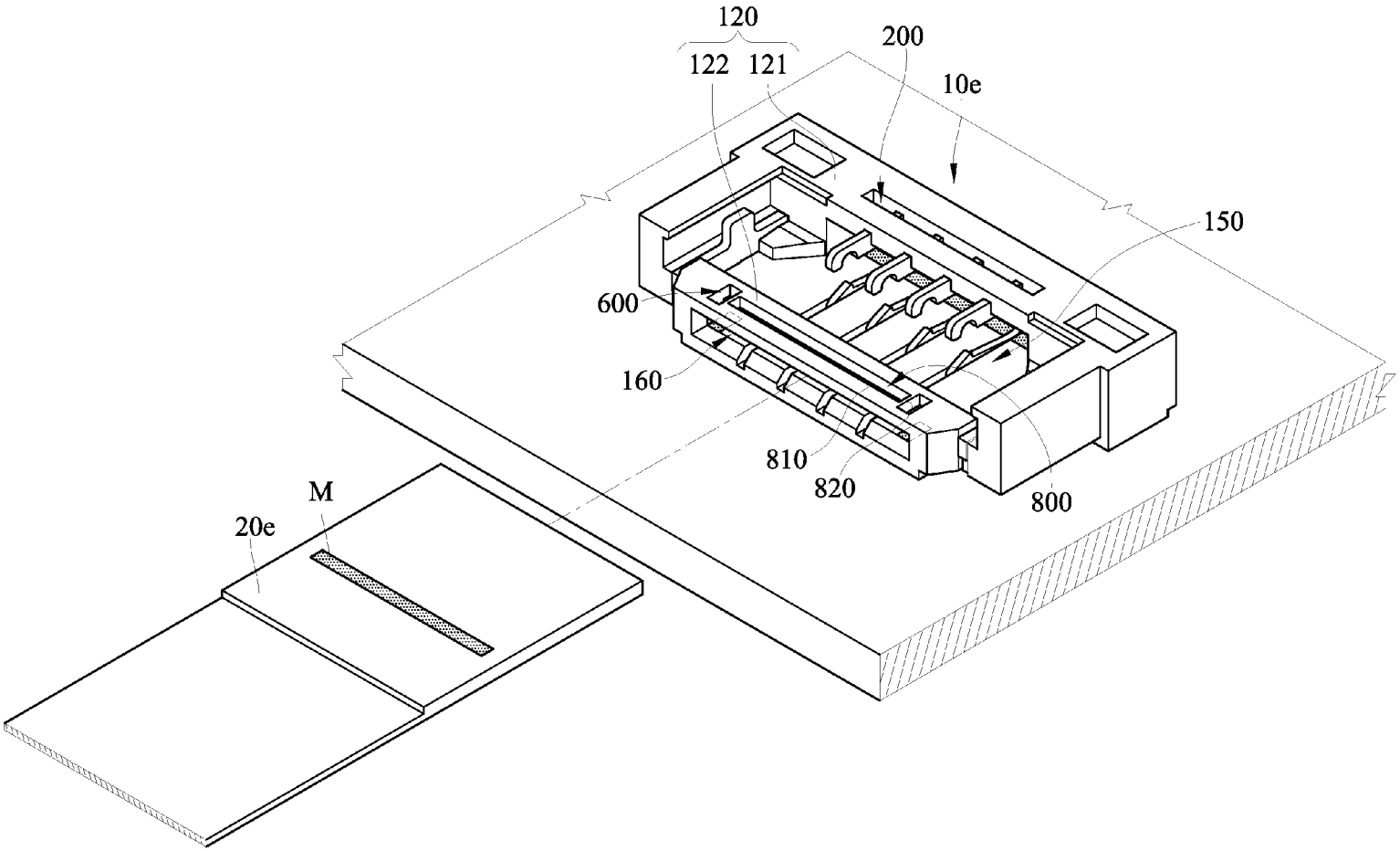
FIG. 11 is a schematic view of a connector and a circuit board according to a fifth embodiment of the disclosure.
Figure 12A:
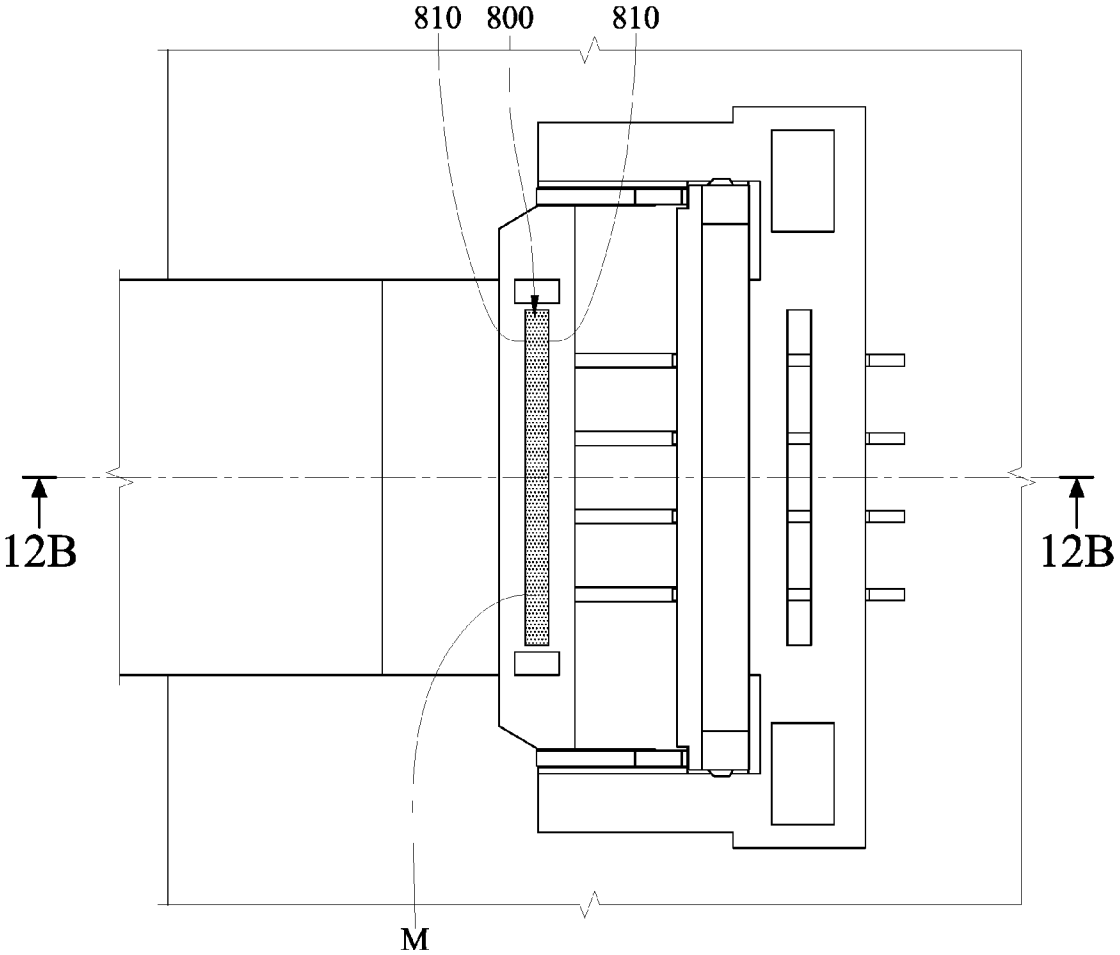
FIG. 12A is a top view of the connector with the flat cable correctly inserted into the connector according to the fifth embodiment of the disclosure.
Figure 12B:
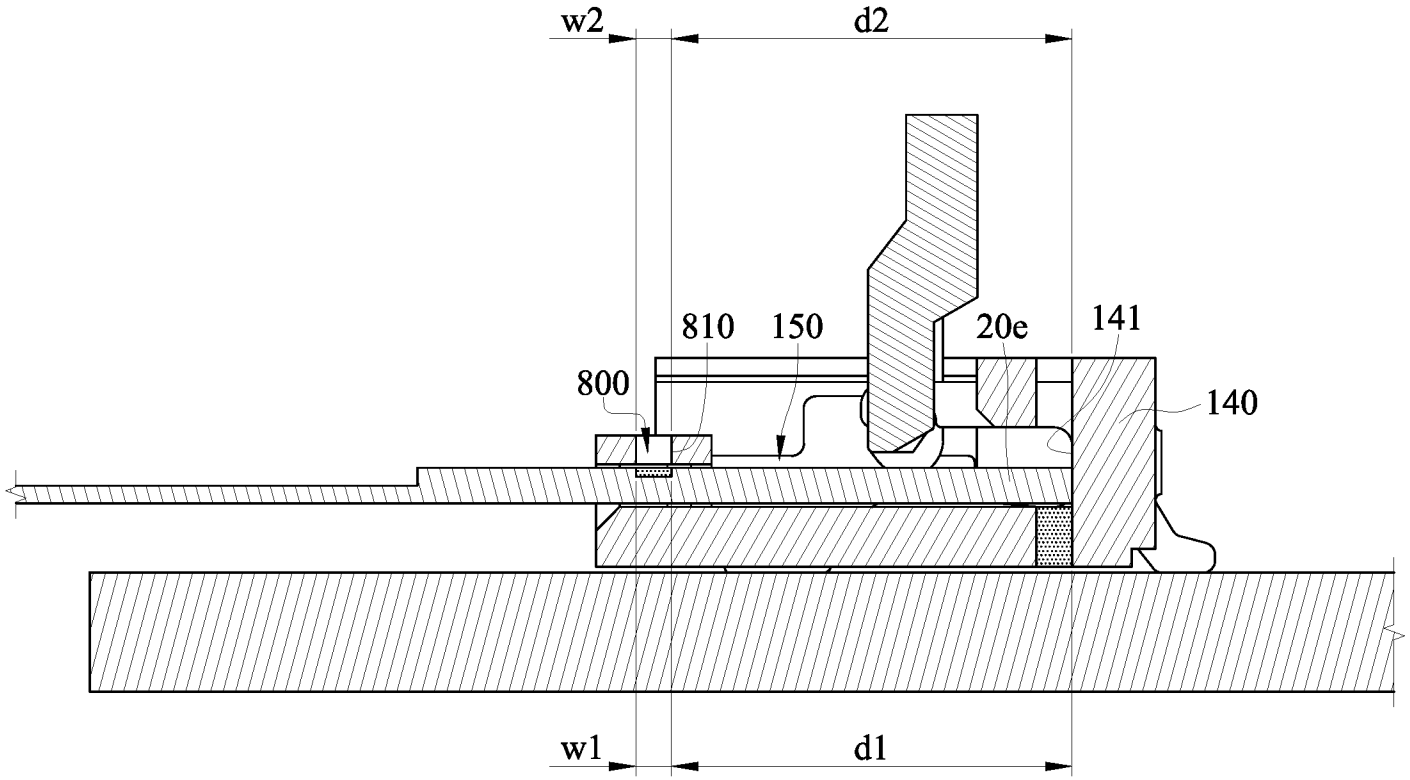
FIG. 12B is a cross-sectional view of the connector and the flat cable along a line 12B-12B in FIG. 12A.
Figure 13A:
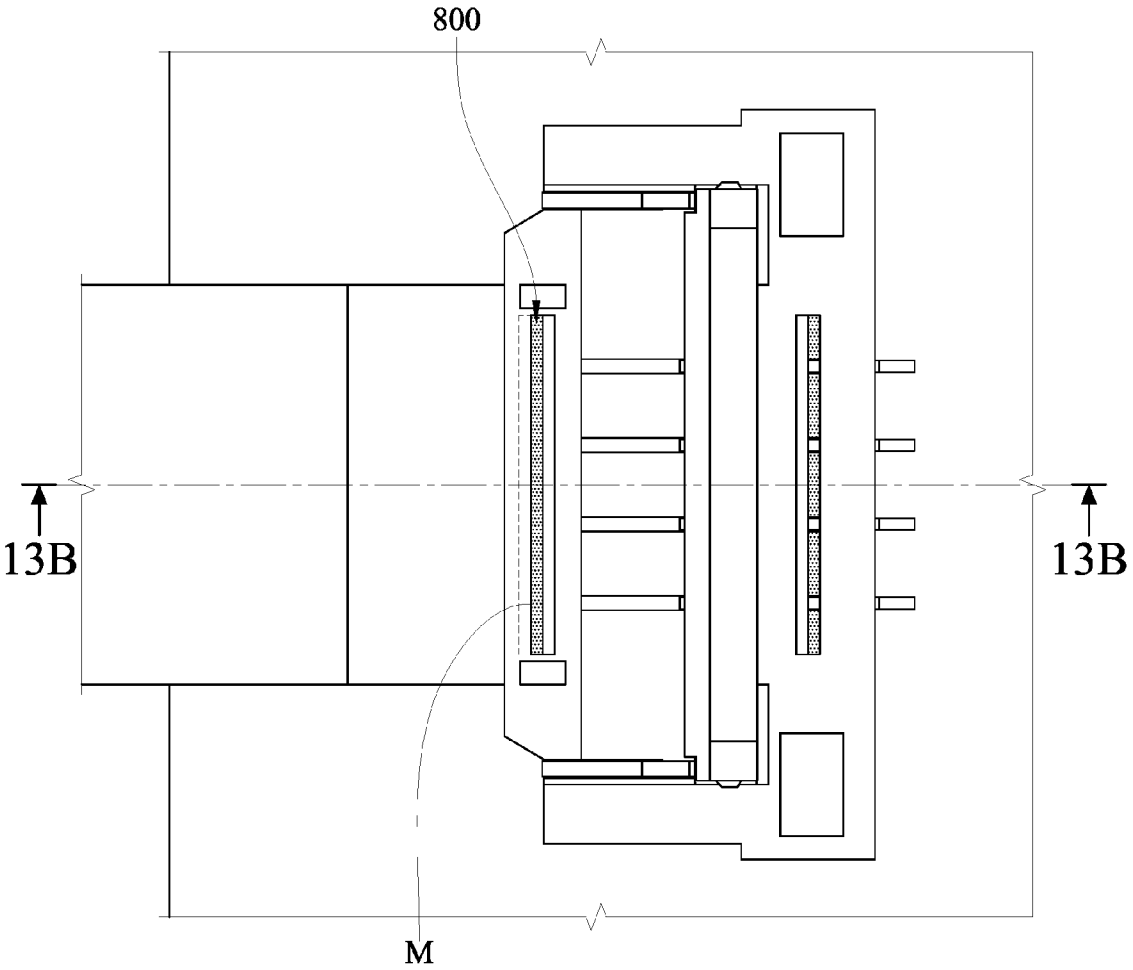
FIG. 13A is a top view of the connector with the flat cable incorrectly inserted into the connector according to the fifth embodiment of the disclosure.
Figure 13B:
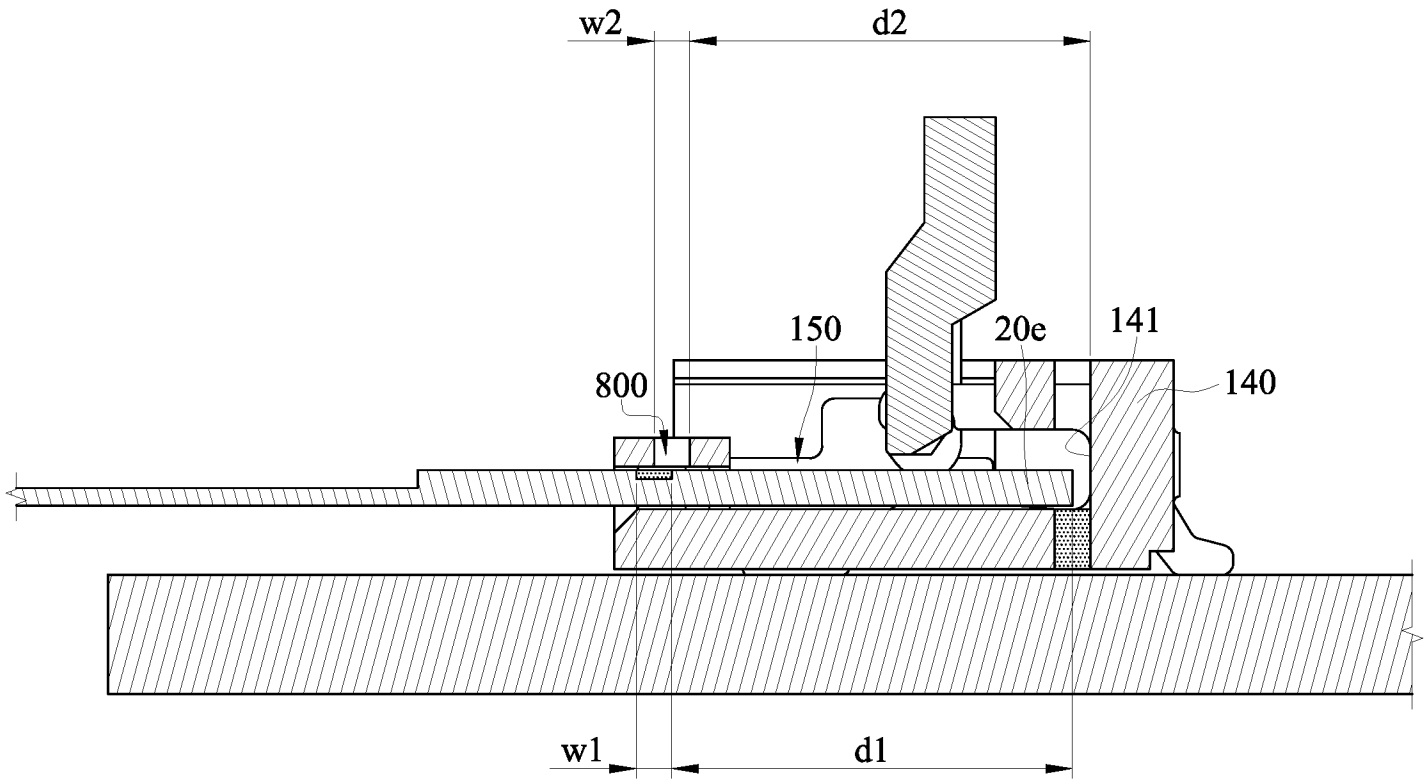
FIG. 13B is a cross-sectional view of the connector and the flat cable along a line 13B-13B in FIG. 13A.

Next, a connector 10*e* according to a fifth embodiment of the disclosure is shown in FIG. 11 to FIG. 13B. FIG. 11 is a schematic view of a connector and a circuit board according to a fifth embodiment of the disclosure. FIG. 12A is a top view of the connector with the flat cable correctly inserted into the connector according to the fifth embodiment of the disclosure. FIG. 12B is a cross-sectional view of the connector and the flat cable along a line 12B-12B in FIG. 12A. FIG. 13A is a top view of the connector with the flat cable incorrectly inserted into the connector according to the fifth embodiment of the disclosure. FIG. 13B is a cross-sectional view of the connector and the flat cable along a line 13B-13B in FIG. 13A. In the fifth embodiment of the disclosure, the connector 10*e* is similar to the connector 10*c* in the third embodiment, and each of the similar components is given the same sign, respectively. The followings are about the differences between the connector 10*e* and the connector 10*c*, and the descriptions of the similar components are not repeated hereafter.

In the fifth embodiment of the disclosure, the connector 10*e* further includes a third inspection window 800. The third inspection window 800 extends through two opposite surfaces of the second part 122 among the top part 120 and is communicated with the flat-cable slot 150. The third inspection window 800 has a long side 810 and a short side 820. The long side 810 is longer than the short side 820. An extending direction of the long side 810 is perpendicular to the insertion direction which the flat cable 20*e* is inserted into the flat-cable slot 150 from the inserting opening 160 along. A section of the flat-cable slot 150 close to the inserting opening is exposed in the third inspection window 800. When the cover 300 is at the fixing position, the third inspection window 800 is covered by the cover 300. When the cover 300 is rotated from the fixing position to the open position, the third inspection window 800 is uncovered so as the quality control stuffs can inspect the position of the flat cable 20*e* in the flat-cable slot 150 through the third inspection window 800.

In the fifth embodiment of the disclosure, the two second inspection windows 600 are spaced apart from the third inspection window 800, but the disclosure is not limited thereto. In other embodiments of the disclosure, both the two second inspection windows are communicated with the third inspection window.

The flat cable 20*e* has a third mark M located on a surface of the flat cable 20*e*. A distance between an edge of the third mark M close to an end of the flat cable 20*e* and the end of the flat cable 20*e* is d1. A distance between the long side 810 of the third inspection window 800 close to the stop surface 141 and the stop surface is d2. The distance d1 is equal to the distance d2. A width of third mark M in an extending direction of the flat cable 20*e* is w1. A width of third inspection window 800 in the inserting direction of the flat cable 20*e* is w2. The width w1 is equal to the width w2. In the fifth embodiment of the disclosure, the third mark M is a color sign, and a color of the color sign is colorful and distinctive, such as red or yellow.

The following is about inspecting the position of the flat cable 20*e* in the flat-cable slot 150 when the cover 300 is at the open position. Please refer to FIG. 12A to FIG. 13B.

As shown in FIG. 12A and FIG. 12B, when the end section of the flat cable 20*e* is correctly inserted into the flat-cable slot 150, the end section of the flat cable 20*e* is abutted against the stop surface 141 of the stopper 140. According to the distance d1 is equal to the distance d2, and the width w1 is equal to the width w2, the third mark M is exposed in the third inspection window 800, which means a visual range of the third inspection window 800 is filled up by the third mark M.

As shown in FIG. 13A and FIG. 13B, when the end section of the flat cable 20*b* is not correctly inserted into the flat-cable slot 150, the end section of the flat cable 20*b* is spaced apart from the stop surface 141 of the stopper 140. Therefore, a part of the third mark M is not exposed in the third inspection window 800, which means the visual range of the third inspection window 800 is not filled up by the third mark M. As a result, whether the visual range of the third inspection window 800 is filled up by the third mark M can be used for determining whether the end section of the flat cable 20*e* is correctly inserted into the flat-cable slot 150 by the quality control stuffs. Moreover, whether a part of the visual range of the third inspection window 800 which is not filled up by the third mark M shows a triangle shaped space or a trapezoid shaped space can be used for determining whether a moving direction of the flat cable 20*e* is deviated from the inserting direction of the flat-cable slot 150. The alignment of the third mark M and the third inspection window 800 can cooperate with the first inspection window 200 and the second inspection window 600 for further improving the precision of the inspection result. Therefore, a situation that the connector 10*e* with a misaligned flat cable 20*e* in the flat-cable slot 150, which causes poor contact between the pins 400 and the metal conductive line, is prevented.

In the fifth embodiment of the disclosure, the third inspection window 800 and the third mark M cooperate with the first inspection window 200, the second inspection window 600, the first mark 500 and the second mark 700 so as to improve the precision of the inspection result. However, the disclosure is not limited to the combination of the first inspection window 200, the first mark 500, the second inspection window 600, the second mark 700, the third inspection window 800 and the third mark M. In other embodiments of the disclosure, the third inspection window and the third mark can cooperate with the first inspection window without the first mark, the second inspection window with the second mark to improve the precision of the inspection result, or the third inspection window and the third mark can cooperate with the first inspection window without the first mark and the second inspection window without the second mark to improve the precision of the inspection result.

Figure 14:
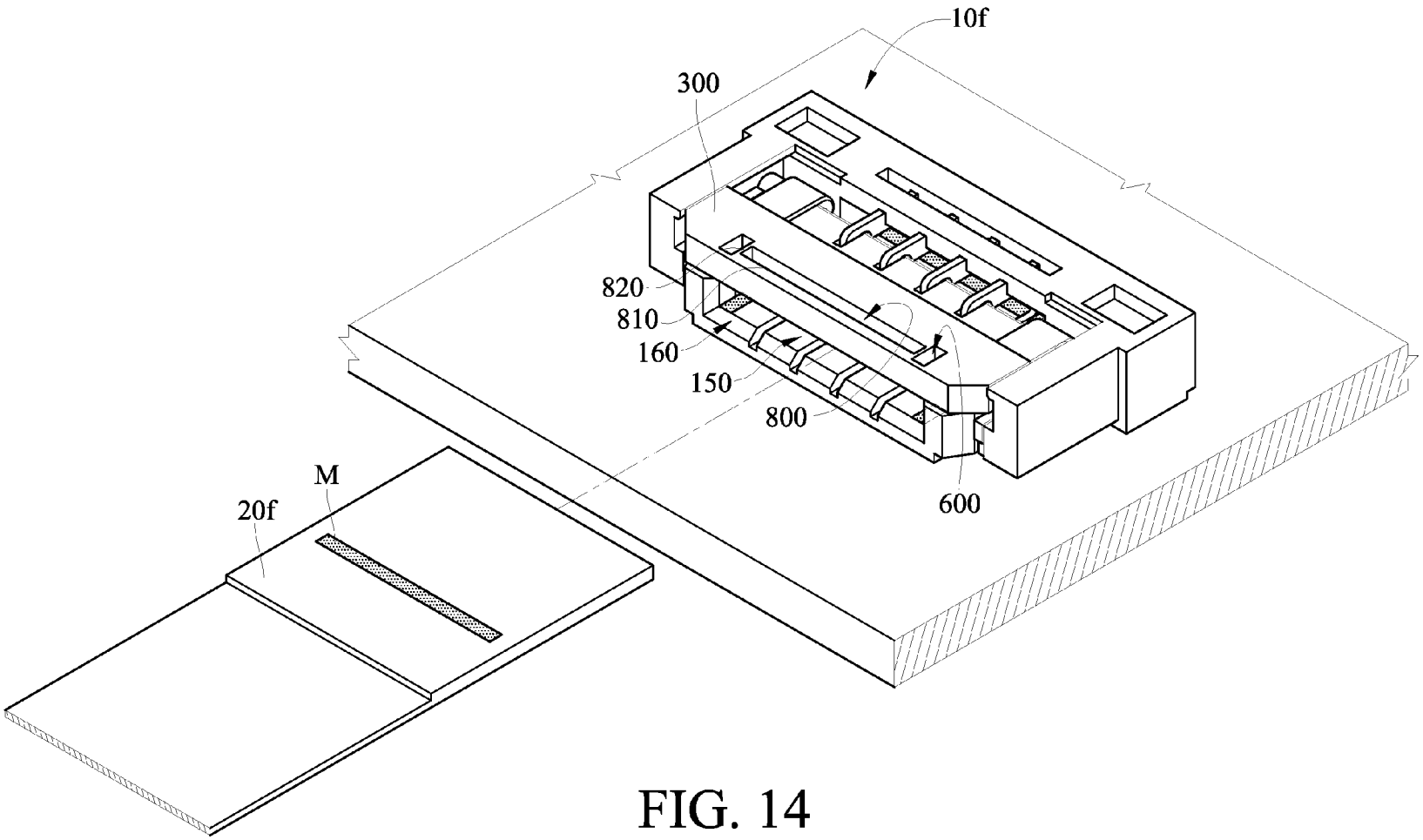
FIG. 14 is a schematic view of a connector and a circuit board according to a sixth embodiment of the disclosure.

Next, a connector 10*f* according to a sixth embodiment of the disclosure is shown in FIG. 14. FIG. 14 is a schematic view of a connector and a circuit board according to a sixth embodiment of the disclosure. In the sixth embodiment of the disclosure, the connector 10*f* is similar to the connector 10*d* in the fourth embodiment, and each of the similar components is given the same sign, respectively. The followings are about the differences between the connector 10*f* and the connector 10*d*, and the descriptions of the similar components are not repeated hereafter.

In the sixth embodiment of the disclosure, the connector 10*f* further includes a third inspection window 800. The third inspection window 800 extends through two opposite surfaces of the cover 300 and is communicated with the flat-cable slot 150. The third inspection window 800 has a long side 810 and a short side 820. The long side 810 is longer than the short side 820. An extending direction of the long side 810 is perpendicular to the insertion direction which the flat cable 20*e* is inserted into the flat-cable slot 150 from the inserting opening 160 along. A section of the flat-cable slot 150 close to the inserting opening is exposed in the third inspection window 800 when the cover 300 is at the fixing position so as the quality control stuffs can inspect the position of the flat cable 20*f* in the flat-cable slot 150 through the third inspection window 800.

In the sixth embodiment of the disclosure, the two second inspection windows 600 are spaced apart from the third inspection window 800, but the disclosure is not limited thereto. In other embodiments of the disclosure, the two second inspection windows are communicated with the third inspection window.

The flat cable 20*f* in the sixth embodiment, which is similar to the flat cable 20*e* in the fifth embodiment, has a third mark M located on a surface of the flat cable 20*f*. In the sixth embodiment of the disclosure, the third mark M is a color sign, and a color of the color sign is colorful and distinctive, such as red or yellow.

In the sixth embodiment of the disclosure, when the flat cable 20*f* is inserted in the flat-cable slot 150, the way that inspecting the position of the flat cable 20*f* in the flat-cable slot 150 when the cover 300 is at the fixing position is similar to the inspecting way in the fifth embodiment of the disclosure. The difference between the inspection way in the sixth embodiment and the inspection way in the fifth embodiment is that the cover 300 is at the fixing position when inspecting the position of the flat cable 20*f* in the sixth embodiment.

According to the connector of the disclosure, the position of the flat cable in the flat-cable slot is inspected through the first inspection window so as to ensure that the flat cable is properly installed in the flat-cable slot. Therefore, poor contact between the flat cable and the connector caused by the improper installation of the flat cable in the connector is prevented.

Moreover, the second inspection window and the third inspection window can cooperate with the first inspection window in inspecting the position of the flat cable in the flat-cable slot. Therefore, the precision of the inspection result, which is about whether the flat cable is correctly inserted into the flat-cable slot and whether the moving direction of the flat cable is deviated from the inserting direction of the flat-cable slot, is improved with the help of the second inspection window and the third inspection window.

What is claimed is:

1. A connector for fixing and electrically connecting a flat cable, comprising:

a base body comprising a bottom part and a top part which are opposite to each other, the bottom part and the top part together forming a flat-cable slot and an inserting opening, and the flat-cable slot and the inserting opening communicated with each other; and a first inspection window extending through two surfaces of the top part which are opposite to each other, the first inspection window communicated with the flat-cable slot, a portion of the flat-cable slot away from the inserting opening exposed in the first inspection window, and a position of the flat cable in the flat-cable slot being inspectable through the first inspection window.

2. The connector of claim 1, wherein the inserting opening is for inserting the flat cable into the flat-cable slot along an inserting direction, and a side of the first inspection window is perpendicular to the inserting direction.

3. The connector of claim 1, further comprising a first mark located at a portion of the flat-cable slot away from the inserting opening, the first mark exposed in the first inspection window, and the position of the flat cable relative to the first mark in the flat-cable slot being inspectable through the first inspection window.

4. The connector of claim 3, wherein the base body further comprises a stopper connected with the top part and the bottom part, the stopper has a stop surface facing the inserting opening, the first mark is connected with the stop surface and exposed in the first inspection window; when the flat cable is inserted into the flat-cable slot, the flat cable is abutted against the stop surface and covers the first mark.

5. The connector of claim 3, wherein the first mark is a through hole.

6. The connector of claim 3, wherein the first mark is a color sign.

7. The connector of claim 3, further comprising a second inspection window and a second mark, the second inspection window extending through the two surfaces of the top part and communicated with the flat-cable slot, the flat cable inserted into the flat-cable slot along an inserting direction, and a side of the second inspection window being parallel to the inserting direction, wherein the base body further comprises two side parts located between the bottom part and the top part, the top part, the bottom part and the two side parts together form the flat-cable slot, each of the two side parts has a side surface, the two side surfaces face each other and are parallel to the inserting direction, the second mark is located at the bottom part and connected to one of the two side surfaces, the second mark is exposed in the second inspection window; when the flat cable is inserted into the flat-cable slot, the flat cable is abutted against the two side surfaces and covers the second mark.

8. The connector of claim 7, wherein the second mark is a through hole.

9. The connector of claim 7, wherein the second mark is a color sign.

10. The connector of claim 7, further comprising a third inspection window, the third inspection window extending through the two surfaces of the top part and communicated with the flat-cable slot, and a side of the third inspection window being perpendicular to the inserting direction, the third inspection window being closer to the inserting opening than the first inspection window, the flat cable having a third mark, wherein when the flat cable is inserted into the flat-cable slot, the third mark is exposed in the third inspection window.

11. The connector of claim 1, further comprising a cover pivoted on the top part with an open position and a fixing position, when the cover being at the fixing position, the cover covering the flat-cable slot and fixing the flat cable in the flat-cable slot, when the cover being at the open position, the cover exposing the flat-cable slot and releasing the flat cable.

12. The connector of claim 11, further comprising a first mark, a second inspection window and a second mark, the first mark located on the bottom part and exposed in the first inspection window, the second inspection window extending through two surfaces of the cover which are opposite to each other, and the second inspection window communicated with the flat-cable slot, the inserting opening being for inserting the flat cable into the flat-cable slot along an inserting direction, and a side of the second inspection window being parallel to the inserting direction, the base body further comprising two side parts located between the bottom part and the top part, the two side parts connected to the bottom part and the top part, the top part, the bottom part and the two side parts together form the flat-cable slot, each of the two side parts having a side surface, the two side surfaces of the two side parts facing each other and being parallel to the inserting direction, the second mark located at the bottom part and connected to one of the two side surfaces; when the cover being at the fixing position, the second mark exposed in the second inspection window, and when the cover being at the fixing position and the flat cable is inserted into the flat-cable slot, the flat cable is abutted against the two side surfaces and covering the second mark.

13. The connector of claim 12, wherein the second mark is a through hole.

14. The connector of claim 12, wherein the second mark is a color sign.

15. The connector of claim 12, further comprising a third inspection window, the third inspection window extending through the two surfaces of the cover and communicated with the flat-cable slot, and a side of the third inspection window being parallel to the inserting direction, the third inspection window being closer to the inserting opening than the first inspection window, and a third mark located at the flat cable, when the cover being at the fixing position and the flat cable located at a predetermined location in the flat-cable slot, the third mark exposed in the third inspection window.

* * * * *